United States Patent [19]

Phoa et al.

[11] Patent Number: 4,791,781

[45] Date of Patent: Dec. 20, 1988

[54] METHOD AND APPARATUS FOR FALSE TWISTING YARN IN OPENED SPINNERS

[76] Inventors: Tek T. Phoa, Bergscheid 39, B-4730 Raeren, Belgium; Joachim Lünenschloss, Schloss-Schonaustrasse 81, 5100 Aachen, Fed. Rep. of Germany

[21] Appl. No.: 34,335

[22] Filed: Apr. 3, 1987

[30] Foreign Application Priority Data

Apr. 4, 1986 [DE] Fed. Rep. of Germany ..... 3611383

[51] Int. Cl.[4] ..... D01H 1/135; D01H 7/892

[52] U.S. Cl. ..... 57/417; 57/400

[58] Field of Search ..... 57/400, 404, 406, 408, 57/413, 414, 416, 417, 401

[56] References Cited

U.S. PATENT DOCUMENTS

| | | | |
|---|---|---|---|
| 3,834,147 | 9/1974 | Havranek et al. | 57/417 |
| 3,973,382 | 8/1976 | Hirai | 57/417 |
| 4,068,456 | 1/1978 | Landwehrkamp | 57/417 |
| 4,110,961 | 9/1978 | Havel et al. | 57/417 |
| 4,385,488 | 5/1983 | Raasch et al. | 57/417 |

*Primary Examiner*—Donald Watkins

*Attorney, Agent, or Firm*—Shefte, Pinckney & Sawyer

[57] ABSTRACT

In open-end rotor spinning, imparting lesser false twist to the yarn being formed as it revolves through the yarn receiving zone and greater false twist as it revolves away from the zone. This is accomplished by different frictional resistance surface characteristics on the surface of a navel, or by shaping the surface for lesser extent of yarn contact in one surface portion and greater extent of yarn contact in another surface portion.

35 Claims, 4 Drawing Sheets

METHOD AND APPARATUS FOR FALSE TWISTING YARN IN OPENED SPINNERS

BACKGROUND OF THE INVENTION

The present invention relates to an open-end rotor spinning method, device and navel, and more particularly to an open-end rotor spinning method, device and navel for imparting false twist when drawing yarn from the fiber collection groove of the rotor of an open-end rotor spinning device.

In open-end rotor spinning the yarn is formed by the progressing end of yarn picking up fibers from the fiber collection groove of the rotating rotor, with false twist being imparted to the yarn being formed as it progresses from the rotor groove and slides over the surface of a stationary navel during draw-off through a central passageway in the navel. It is desirable that false twist be increased to strengthen the yarn during formation so that a yarn can be produced of strength and quality resembling as much as possible the desirable qualities of ring-spun yarn.

However, in increasing the false twist during open-end rotor spinning there is a problem of unevenness in quality and appearance resulting from the undesirable attachment of wrapper fibers on the yarn as the yarn progresses through the zone of the rotor groove where the loose fibers are being blown into the groove. These wrapper fibers accumulate on the surface of the yarn without being structurally incorporated in the twisted fibers and provide an uneven appearance. This undesirable formation of wrapper fibers on the yarn is increased when more false twist is being imparted to the yarn as it passes through the fiber receiving zone of the rotor.

SUMMARY OF THE INVENTION

It is the purpose of the present invention to obtain increased false twist in forming open-end rotor spun yarn so that the yarn may more nearly resemble ring-spun yarn while minimizing the accumulation of undesirable wrapper fibers on the yarn. This is accomplished generally by the present invention by increasing the false twist imparted to the yarn being formed as the yarn formation passes around the rotor groove outside the fiber receiving zone and reducing the false twist imparted to the yarn being formed as the yarn formation passes through the fiber receiving zone.

Briefly described, the method of the present invention is a method for varying the false twist imparted to a yarn as it is being formed in an open-end rotor spinning device to minimize the unevenness imparted by wrapper yarns picked up as the yarn formation passes through the fiber receiving zone of the rotor. The method comprises reducing the false twist imparted to the yarn being formed as it passes through the fiber receiving zone and increasing the false twist imparted to the yarn being formed as it passes outside the fiber receiving zone. Preferably, the reduced false twist is imposed on the yarn as it passes through the fiber receiving zone and immediately prior thereto over a range of 10 degrees to 180 degrees, preferably approximately 60 degrees, of the circumference of the rotor. The reducing of the false twist may extend from up to 45 degrees in advance of the fiber receiving zone into the zone.

Preferably the varying false twist is imparted to the yarn as it is drawn-off the rotor groove and through the navel and is accomplished by reducing frictional resistance to yarn draw-off as the yarn being formed passes through the fiber receiving zone and increasing frictional resistance as the yarn passes outside the fiber receiving zone. This varying of the false twist being imparted can also be accomplished by reducing and increasing the length of the draw-off path of the yarn as it is being formed.

The open-end rotor spinning device of the present invention includes a rotating hollow rotor having an interior circumferential groove formed therein. Means are provided for feeding fibers into the rotor for receipt in the rotor groove in a fiber receiving zone. A navel is disposed within the hollow rotor and means are provided for drawing-off yarn being formed from fibers in the rotor groove through the navel with a false twist being imparted thereto. Means are provided for reducing the false twist imparted to the yarn being formed as it passes through the fiber receiving zone and increasing the false twist imparted to the yarn being formed as it passes outside the fiber receiving zone.

Preferably, the means for reducing and increasing the false twist imparts reduced false twist through the fiber receiving zone and immediately prior thereto. This may be over a range of 10 degrees to 180 degrees, preferably approximately 60 degrees of the circumference of the rotor, and from up to 45 degrees in advance of the fiber receiving zone.

The means for reducing and increasing the false twist may include yarn engaging surfaces on the navel having portions with friction characteristics of lesser and greater frictional resistance to sliding of yarn thereover to thereby impart reduced and increased false twist respectively. This can be accomplished by the surface portion of the navel with greater frictional resistance being a roughened surface, such as a surface formed with a coating having partially embedded particles of a hard material, preferably diamond particles. Alternatively, the roughened surface may be formed as a pitted surface.

In one embodiment of the device of the present invention, the surface portion of lesser frictional resistance is provided with a rotatable insert to provide rolling frictional resistance to the yarn sliding thereover.

In another embodiment of the device of the present invention, the means for reducing and increasing the false twist is in the form of a portion of the yarn engaging surface of the navel having a lesser extent of yarn contact for imparting reduced false twist and another portion of the yarn engaging surface of the navel having a greater extent of yarn contact for imparting increased false twist. This may be obtained by the surface portions being curved and with the surface portion of lesser extent of yarn contact having a lesser radius of curvature and the surface portion of greater extent of yarn contact having a greater radius of curvature. Alternatively, this result can be obtained by having the navel formed with its yarn passage offset toward the fiber receiving zone, or the lesser extent of yarn contact may be obtained by the surface being recessed away from the rotor groove in the yarn receiving zone. In another form, the lesser extent of yarn contact is obtained by the navel being inclined toward the yarn receiving zone of the rotor, preferably at an inclination of between 0 degrees and 60 degrees. The navel may be rotatably adjustable angularly within the rotor to adjust the angular relationship of the navel surfaces with respect to the fiber receiving zone of the rotor for best results.

The navel of the present invention has a circumferentially extending yarn engaging surface having circumferential portions with friction characteristics of lesser and greater frictional resistance to sliding of yarn thereover. Preferably, the greater frictional resistance is obtained by a roughened surface that may have a coating containing partially embedded particles of hard material, such as diamond particles. Alternatively, the roughened surface may be a pitted surface.

In another form of the navel of the present invention, the surface portion of lesser frictional resistance contains a rotatable insert to provide rolling frictional resistance to the yarn sliding thereover.

In another form of the navel of the present invention, the circumferentially extending yarn engaging surface has circumferential portions of lesser and greater extent of yarn contact, which may be provided by the yarn passageway of the navel being offset, or the surface portion of lesser extent of yarn contact being recessed circumferentially, or the surface portion of lesser extent being curved with a lesser radius of curvature and the surface portion of greater extent of yarn contact being curved at a greater radius of curvature.

Other and further features of the present invention will be apparent from the accompanying drawings and following detailed description.

DETAILED DESCRIPTION OF THE PREFERRED EMBODIMENTS

Figure 1:
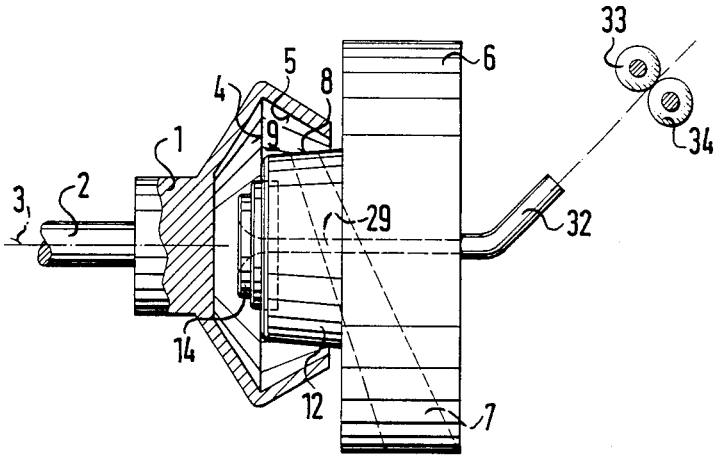
FIG. 1 is an elevational view, partially in section, of parts of an open-end rotor spinning device incorporating the preferred embodiment of the device and navel of the present invention and in which the method of the preferred embodiment of the present invention is performed.
Figure 2:
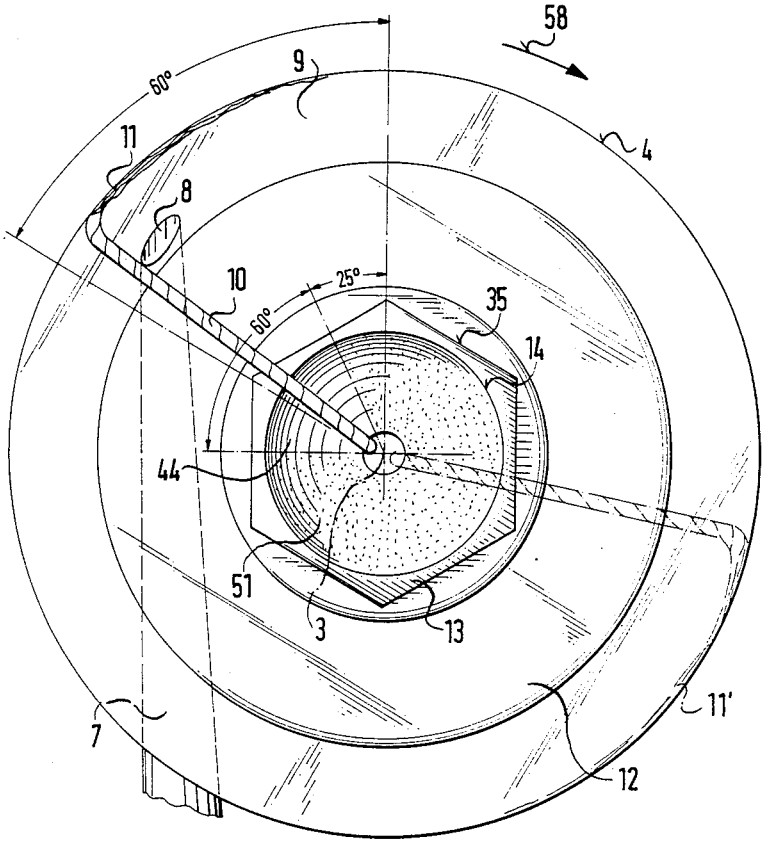
FIG. 2 is an enlarged elevational view of the navel, face plate and interior of the rotor of the device of FIG. 1.

Referring first to FIGS. 1 and 2, an open-end rotor spinning device incorporating the present invention is illustrated. This device includes a rotor 1 having a shaft 2 on which the rotor rotates about an axis 3 by conventional drive means, not shown. The rotor has a fiber receiving groove 4 and an inclined wall 5 for receiving fibers and directing them into the groove 5. A face plate 6 covers the rotor 1 and includes a fiber feeding conduit 7 opening at 8 in the direction of the rotor wall 5. As shown in FIG. 2, a fiber receiving zone 9 extends in front of the opening 8 of the fiber delivery conduit 7 at an angle of, for example, 60 degrees, which zone is passed through by the yarn 10 being formed during each revolution of the yarn. The yarn forming zone 11 extends from the end of the yarn being formed over an angle of approximately 40 degrees in the embodiment illustrated. In conventional devices, as the yarn formation and its forming zone 11 revolves and passes through the yarn receiving zone 9, wrapper fibers are picked-up as they are blown onto the rotor surface 5 and into the groove 4. It is the purpose of the present invention to minimize this pick-up of wrapper fibers.

Figure 5:
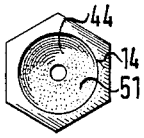
FIG. 5 is a front elevation of the navel of FIG. 1.
Figure 6:
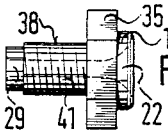
FIG. 6 is a side elevation of the navel of FIG. 5.

The face plate 6 has a projection 12 that extends into the hollow rotor 1 and includes a recess 13 concentric with the axis of rotation 3, from which recess a central bore extends with threads for threaded mounting therein of a navel of the type illustrated in FIGS. 5 and 6. This navel 14 has a yarn inlet passageway 22 that merges into a yarn conduit 29 through which the yarn passes to a draw-off tube 32 that guides the yarn to a pair of draw-off rollers 33 and 34.

As illustrated in FIGS. 5 and 6, the navel 14 is mounted in a support that has a hexagonal head 35 and a neck 38 having threads 41 for mounting in the face plate 6. The navel 14 has a surface portion 44 of lesser frictional resistance to sliding of the yarn 10 thereover and another portion 51 having greater frictional resistance to sliding of yarn thereover. In the preferred embodiment the difference in frictional characteristics is obtained by a coating on the surface 51 of partially embedded diamond particles, with the surface 44 of lesser frictional characteristics being uncoated.

In the preferred embodiment illustrated the uncoated surface portion 44 extends circumferentially through an angle of approximately 60 degrees. This angle can be in the range of 10 degrees to 180 degrees, and is preferably in the range of 30 degrees to 90 degrees. As the zone 11 of formation of the yarn extends in advance of the location of the yarn being drawn-off the rotor groove 4, the uncoated surface portion 44 of lesser frictional resistance is offset in advance of the fiber receiving zone 9. As illustrated in FIG. 2, the fiber receiving zone 9 extends through an angle of 60 degrees and the uncoated surface portion of lesser frictional resistance is offset 25 degrees so that the yarn 10 engages the surface of lesser frictional resistance, thereby having less false twist imparted thereto, immediately prior to passing through the fiber receiving zone and continues with lesser false twist imparted thereto into the fiber receiving zone 9. This offset of the surface 44 of lesser frictional resistance may be up to as much as 45 degrees in advance with respect to the direction of rotation, indicated by the arrow 58.

The uncoated surface 44 of lesser frictional resistance is a smooth surface, while the diamond coated surface is roughened thereby, which roughened condition could alternatively be obtained by forming the surface as a pitted surface or other similar form.

As illustrated in FIG. 2, with the offset arrangement described above, when the end of the yarn 10 is located in the middle of the lesser frictional resistance portion 44, the forming zone 11 of the yarn is located in the middle of the fiber receiving zone 9, which demonstrates the optimum relationship of the offset of the surface portion 44 with respect to the fiber receiving zone 9. As illustrated in FIG. 2 in phantom lines, the yarn forming zone 11' is considerably longer when the yarn is passing over the surface 51 of greater frictional resistance, during which time the false twist imparted by the revolving of the yarn under the frictional resistance of the surface 51 is increased.

Figure 3:
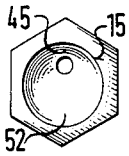
FIG. 3 is a front elevation of an alternative embodiment of the navel illustrated in FIGS. 1 and 2.
Figure 4:
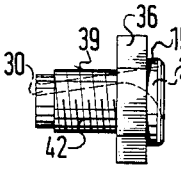
FIG. 4 is a side elevation of the navel of FIG. 3.

In the alternative embodiment of FIGS. 3 and 4, the navel 15 is formed with a surface portion 45 of its inlet passageway 23 having a smaller extent of yarn contact and the other portion 52 having a greater extent of yarn contact. This is accomplished by the yarn inlet passageway 23 being offset eccentrically. This eccentricity is adjusted by angularly adjusting the position of the navel 15 in the support 36 so that when the support is threaded by the threads 42 on the neck 39 into the face plate 6 the offset will be positioned similar to the positioning of the uncoated surface 44 as illustrated for the embodiment of FIG. 2. With this offset arrangement the yarn travels through the inlet passageway 23 and obliquely through a conduit 30 to be drawn-off through the tube 32 illustrated in FIG. 1.

As seen in FIG. 3, the yarn contacts the surface portion 45 of the navel 15 over a shorter path of contact while contacting the other surface portion 52 over a longer path of contact.

Figure 15:
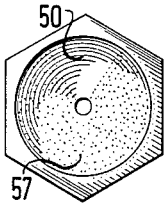
FIG. 15 is a front elevation of a navel angularly adjustably mounted in a threaded support in accordance with an embodiment of the present invention.
Figure 16:
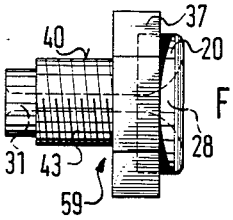
FIG. 16 is a side elevation of the navel and support of FIG. 15.

FIGS. 15 and 16 illustrate another angularly adjustably mounted navel 20. In this embodiment the yarn inlet passageway 22 is formed with a surface portion 50 that is smooth and has a lesser frictional resistance that imparts lesser false twist to yarn passing thereover, and a portion 57 that is roughened by pitting in any conventional manner to provide greater frictional resistance and thereby impart greater false twist to yarn being formed as it passes thereover from the rotor groove. In this embodiment, the navel 20 is adjustably mounted in a manner similar to that described above in a support 59 that has a hexagonal head 37 and a neck 40 that is threaded, as indicated at 43, for mounting in the face plate 6, and has a conduit 31 through which the yarn passes to the draw-off tube 32. The navel 20 of this embodiment as well as the navels of all the other embodiments are mounted in the support by a light press fit that maintains the angular relationship, but allows adjustment as desired for optimum operating conditions.

Figure 7:
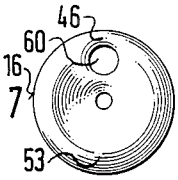
FIG. 7 is a front elevation of another embodiment of the navel of the present invention.
Figure 8:
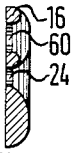
FIG. 8 is a vertical sectional view of the navel of FIG. 7.

Referring to FIGS. 7 and 8, the navel 16 of an alternate embodiment is shown formed with an opening 60 at an offset from the yarn inlet passageway 24 in the surface portion 46 that is to be angularly positioned at the fiber receiving zone 9. This opening 60 eliminates yarn contact as the yarn passes over the opening 60, thereby reducing frictional resistance and imparting lesser false twist. Otherwise, the entire surface of the navel, including the surface 53 that does not include the opening 60, is roughened, for example, in the same manner as the surface 57 of the navel 20 of FIGS. 15 and 16, to provide greater frictional resistance to yarn passage and, therefore, greater false twist imparting to the yarn, except in the portion 46 containing the opening 60. Alternatively, the surface portion 56 can be formed of less roughness or may be smooth to further reduce the frictional resistance.

Figure 9:
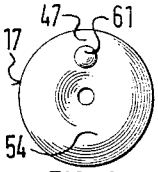
FIG. 9 is a front elevation of a further embodiment of the navel of the present invention.
Figure 10:
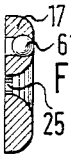
FIG. 10 is a vertical sectional view of the navel of FIG. 9.

In the alternative embodiment illustrated in FIGS. 9 and 10, the navel 17 is formed with a ball insert 61 rotatably mounted in a surface portion 47 so that as the yarn passes over the ball 61 it encounters only rolling friction whereas it encounters the greater resistance of sliding friction as it passes over the remaining surface portion 54, which may be roughened for greater frictional resistance and, therefore, greater imparting of false twist. A roller in a form other than a rotatable ball 61 may be substituted in this embodiment.

Figure 11:
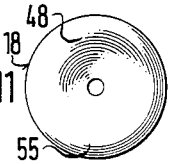
FIG. 11 is a front elevation of another embodiment of the navel of the present invention.
Figure 12:
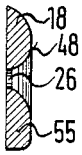
FIG. 12 is a vertical sectional view of the navel of FIG. 11.

Referring to the embodiment of FIGS. 11 and 12, the navel 18 is seen to have an unsymmetrically configured yarn inlet passage 26 in which the surface portion 48 has a curvature with a smaller radius of curvature and the other surface portion 55 has a curvature with a larger radius of curvature such that the yarn has an extent of contact with the surface portion 48 approximately half the extent of surface contact with the surface portion 55 so that when the lesser surface contact portion 48 is positioned adjacent the fiber receiving zone 9 there will be lesser frictional resistance to the yarn and, therefore, lesser false twist imparted.

Figure 13:
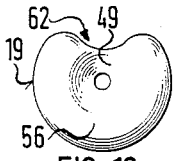
FIG. 13 is a front elevation of a further embodiment of the navel of the present invention.
Figure 14:
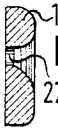
FIG. 14 is a vertical sectional view of the navel of FIG. 13.

Referring to the embodiment of FIGS. 13 and 14, the navel 19 is formed with the surface of the yarn inlet passage 27 irregularly shaped to provide a surface 49 of lesser extent of yarn contact and a surface 56 of greater extent of yarn contact. This is accomplished by forming the surface portion 49 circumferentially recessed to reduce the yarn contacting extent.

Figure 17:
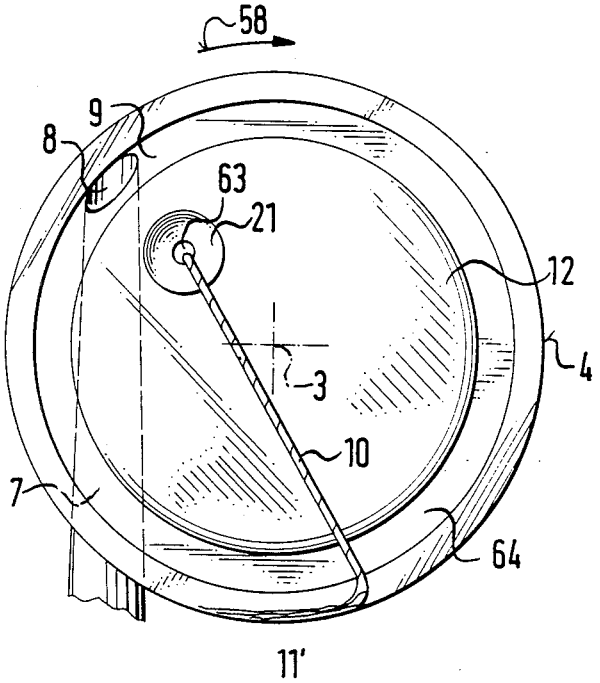
FIG. 17 is a view similar to FIG. 2 illustrating an alternative embodiment of the present invention.

In the embodiment illustrated in FIG. 17, the navel 21 may be of any of the forms described above or may be of conventional form. In this device, the lesser and greater false twist imparting is obtained by mounting the navel 21 in the face plate projection 12 eccentrically with respect to the axis 3 of rotation of the rotor and offset in the direction of the fiber receiving zone 9 so that the path of the yarn 10 progressing from the rotor groove 4 to the yarn inlet passageway 63 of the navel 21 is shorter, therefore reducing the amount of false twist that can be imparted, as the yarn revolves through the fiber receiving zone 9 and is considerably longer, thereby imposing greater false twist, as the yarn revolves through the remaining portion 64 of the rotor groove.

Figure 18:
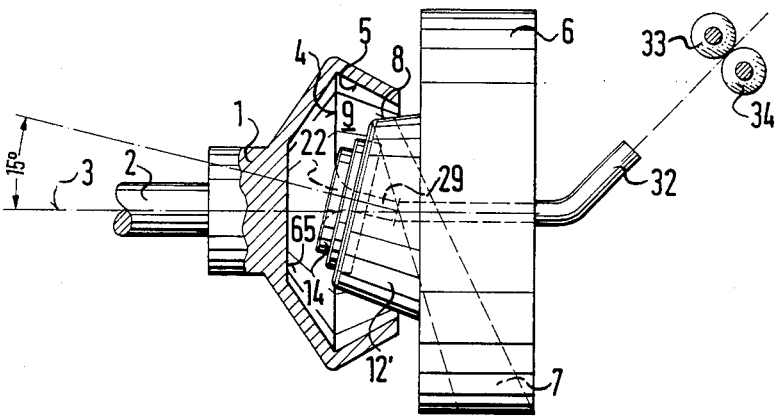
FIG. 18 is a view similar to FIG. 1 illustrating another embodiment of the present invention.

In the embodiment illustrated in FIG. 18, the navel 14 of the type described above in relation to FIGS. 1, 2, 5 and 6 is mounted in a projection 42' of the face plate 6 at an inclination to the axis 3 of rotation such that instead of being directed toward the bottom 65 of the rotor 5 as in FIG. 1, it is inclined partially toward the yarn receiving zone 9. With this arrangement the yarn is in contact with the navel surface over a smaller extent as the yarn revolves through the fiber receiving zone and is in surface contact over a larger extent as it passes over the other surface portion away from the fiber receiving zone, thereby having lesser false twist imparted thereto as it revolves through the fiber receiving zone and greater false twist imparted thereto as it revolves through the other portion of the rotor groove.

Alternatively, the same type of inclination and resulting lesser and greater false twist imparting could be obtained by inclining the yarn inlet passage 22 and the surface portions of the navel while otherwise forming the navel for mounting in a face plate projection such as the projection 12 of FIG. 1 or offset as in FIG. 17.

It will therefore be readily understood by those persons skilled in the art that the present invention is susceptible of a broad utility and application. Many embodiments and adaptations of the present invention other than those therein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A method of varying the false twist imparted to a yarn as it is being formed in an open-end rotor spinning device to minimize the unevenness imparted by wrapper yarns picked up as the yarn formation passes through the fiber receiving zone of the rotor, said method comprising reducing the false twist imparted to the yarn being formed as it passes through the fiber receiving zone and increasing the false twist imparted to the yarn being formed as it passes outside the fiber receiving zone.

2. A method according to claim 1 and characterized further in that said reducing is imposed on the yarn being formed as it passes through the fiber receiving zone and immediately prior thereto.

3. A method according to claim 2 and characterized further in that said reducing of the false twist is imposed over a range of 10° to 180° of the circumference of the rotor.

4. A method according to claim 2 and characterized further in that said reducing of the false twist is imposed over approximately 60° of the circumference of the rotor.

5. A method according to claim 2 and characterized further in that said reducing of false twist extends from up to 45° in advance of said fiber receiving zone into said zone.

6. A method according to claim 1 and characterized further in that the varying false twist is imparted to the yarn as it is drawn-off the rotor groove and through a navel.

7. A method according to claim 6 and characterized further in that said reducing and increasing false twist is accomplished by reducing frictional resistance to yarn draw-off as the yarn being formed passes through the fiber receiving zone and increasing frictional resistance as the yarn passes outside the fiber receiving zone.

8. A method according to claim 6 and characterized further in that said reducing and increasing false twist is accomplished by reducing and increasing the length of the draw-off path of the yarn as it is being formed.

9. An open-end rotor spinning device comprising a rotating hollow rotor having an interior circumferential groove formed therein, means for feeding fibers into said rotor for receipt in said rotor groove in a fiber receiving zone, a navel disposed within said hollow rotor, means for drawing-off yarn being formed from fibers in said rotor groove through said navel with a false twist being imparted thereto, and means for reducing the false twist imparted to the yarn being formed as it passes through said fiber receiving zone and increasing the false twist imparted to the yarn being formed as it passes outside the fiber receiving zone.

10. An open-end rotor spinning device according to claim 9 and characterized further in that said means for reducing and increasing the false twist imparts reduced false twist to the yarn as it is being formed through the fiber receiving zone and immediately prior thereto.

11. An open-end rotor spinning device according to claim 10 and characterized further in that said means for reducing and increasing the false twist imparts reduced false twist over a range of 10° to 180° of the circumference of the rotor.

12. An open-end rotor spinning device according to claim 10 and characterized further in that said means for reducing and increasing the false twist imparts reduced twist over approximately 60° of the circumference of the rotor.

13. An open-end rotor spinning device according to claim 10 and characterized further in that said means for reducing and increasing the false twist imparts reduced false twist from up to 45° in advance of said fiber receiving zone into said zone.

14. An open-end rotor spinning device according to claim 9 and characterized further in that said means for reducing and increasing the false twist comprises yarn engaging surfaces on said navel having portions with friction characteristics of lesser and greater frictional resistance to sliding of yarn thereover to thereby impart reduced and increased false twist respectively.

15. An open-end rotor spinning device according to claim 14 and characterized further in that the surface portion of the navel with greater frictional resistance is a roughened surface.

16. An open-end rotor spinning device according to claim 15 and characterized further in that said roughened surface is formed with a coating having partially embedded particles of a hard material.

17. An open-end rotor spinning device according to claim 16 and characterized further in that said particles of hard material are diamond particles.

18. An open-end rotor spinning device according to claim 15 and characterized further in that said roughened surface portion is a pitted surface.

19. An open-end rotor spinning device according to claim 14 and characterized further by a rotatable insert in the surface portion of lesser frictional resistance to provide rolling frictional resistance to the yarn sliding thereover.

20. An open-end rotor spinning device according to claim 9 and characterized further in that said means for reducing and increasing the false twist comprises a portion of the yarn engaging surface of said navel having a lesser extent of yarn contact for imparting reduced false twist and another portion of the yarn engaging surface of said navel having a greater extent of yarn contact for imparting increased false twist.

21. An open-end rotor spinning device according to claim 20 and characterized further in that the surface portion of lesser extent of yarn contact is a curved surface having a lesser radius of curvature and the surface portion of greater extent of yarn contact is a curved surface having a greater radius of curvature.

22. An open-end rotor spinning device according to claim 20 and characterized further in that said navel has a yarn passage offset toward said fiber receiving zone to reduce the extent of yarn contact thereat and to increase the extent of yarn contact outside said zone.

23. An open-end rotor spinning device according to claim 20 and characterized further in that said portion of the yarn engaging surface having a lesser extent of yarn contact is recessed away from said rotor groove in said yarn receiving zone to reduce the extent of surface contact by the yarn.

24. An open-end rotor spinning device according to claim 20 and characterized further in that said navel is inclined toward said yarn receiving zone of said rotor to provide said lesser and greater extent of yarn contact.

25. An open-end rotor spinning device according to claim 24 and characterized further in that the inclination of said navel is between 0° and 60°.

26. An open-end rotor spinning device according to claim 9 and characterized further in that said means for reducing and increasing false twist is means for supporting said navel at a position offset toward the fiber receiving zone of said rotor.

27. An open-end rotor spinning device according to claim 26 and characterized further in that said navel is inclined toward said yarn receiving zone of said rotor.

28. An open-end rotor spinning device according to claim 9 and characterized further in that said navel is adjustably mounted for rotatable adjustment angularly within said rotor.

29. A navel for use in an open-end rotor spinning device comprising a circumferentially extending yarn engaging surface having circumferential portions with friction characteristics of lesser and greater frictional resistance to sliding of yarn thereover, said surface portion with greater frictional resistance being a roughened surface formed with a coating having partially embedded particles of a hard material.

30. A navel according to claim 29 and characterized further in that said particles are diamond particles.

31. A navel for use in an open-end rotor spinning device comprising a circumferentially extending yarn engaging surface having circumferential portions with friction characteristics of lesser and greater frictional resistance to sliding thereover, and a rotatable insert in the surface portion of lesser frictional resistance to provide rolling frictional resistance to the yarn sliding thereover.

32. A navel for use in an open-end rotor spinning device comprising a circumferentially extending yarn engaging surface having circumferential portions of lesser and greater extent of yarn contact.

33. A navel according to claim 32 and characterized further in that said navel has a yarn passageway therethrough offset to provide said circumferential surface portions of lesser and greater extent.

34. A navel according to claim 32 and characterized further in that said surface portion of lesser extent of yarn contact is a curved surface having a lesser radius of curvature and the surface portion of greater extent of yarn contact is a curved surface having a greater radius of curvature.

35. A navel according to claim 32 and characterized further in that said surface portion of lesser extent of yarn contact is recessed circumferentially to reduce the extent of yarn contact.

* * * * *